US007275375B2

(12) United States Patent
Kim

(10) Patent No.: US 7,275,375 B2
(45) Date of Patent: Oct. 2, 2007

(54) REGENERATOR AND CRYOCOOLER USING THE SAME

(75) Inventor: Seon-Young Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 10/965,918

(22) Filed: Oct. 18, 2004

(65) Prior Publication Data

US 2005/0223715 A1 Oct. 13, 2005

(30) Foreign Application Priority Data

Dec. 1, 2003 (KR) ..... 10-2003-0086559

(51) Int. Cl.
*F25B 9/00* (2006.01)
*F28D 17/00* (2006.01)

(52) U.S. Cl. ..... 62/6; 165/4

(58) Field of Classification Search ..... 62/6; 165/4, 6, 10

See application file for complete search history.

(56) References Cited

U.S. PATENT DOCUMENTS

| | | | | |
|---|---|---|---|---|
| 6,475,935 | B1 * | 11/2002 | Ishizaki et al. | 442/188 |
| 6,688,113 | B1 * | 2/2004 | Kunimoto et al. | 62/6 |
| 6,694,730 | B2 * | 2/2004 | O'Baid et al. | 60/520 |
| 2002/0139510 | A1 * | 10/2002 | Ishizaki | 165/10 |
| 2004/0079515 | A1 * | 4/2004 | Fieback et al. | 165/10 |
| 2005/0166602 | A1 * | 8/2005 | Park et al. | 62/6 |

* cited by examiner

*Primary Examiner*—William C Doerrler
(74) *Attorney, Agent, or Firm*—Birch, Stewart, Kolasch & Birch, LLP

(57) ABSTRACT

A regenerator includes a casing including a connection channel for making a high temperature part and a cooling part communicate with each other; and a thermal energy storage material inserted in the connection channel of the casing and made of an aramid fiber which stores/radiates heat of a working fluid flowing through the connection channel. A cryocooler includes the regenerator. Accordingly, regeneration performance of storing heat included in the working fluid and transmitting the stored heat to a working fluid is improved, and simultaneously a weight is decreased, thereby minimizing abrasion of components.

12 Claims, 3 Drawing Sheets

REGENERATOR AND CRYOCOOLER USING THE SAME

This Non-provisional application claims priority under 35 U.S.C. 119(a) on Patent Application No(s). 10-2003-0086559 filed in Korea, Republic of on Dec. 1, 2003, the entire contents of which are hereby incorporated by reference.

BACKGROUND OF THE INVENTION

1. Field of the Invention

The present invention relates to a regenerator and a cryocooler using the same, and more particularly, to a regenerator and a cryocooler using the same capable of improving regeneration performance of storing heat included in a working fluid and transmitting the stored heat to the working fluid and of minimizing a weight.

2. Description of the Background Art

In general, a cryocooler is mainly used to cool small electronic components, superconductors or the like. As the cryocooler, there are a Stirling cycle cooler, a pulse tube cooler and the like.

The cryocooler includes a high temperature part for generating heat while compressing a working fluid by converting electrical energy into kinetic energy; and a cooling part rapidly cooled by a working fluid which is expanded by a pulse difference of the compressed operation and absorbs external heat. And, a channel through which a working fluid flows between the high temperature part and the cooling part is formed, and a regenerator including a thermal energy storage material exchanging heat with the working fluid is mounted at the channel.

That is, in a process that a working fluid flows from the high temperature part to the cooling part, heat included in the working fluid is absorbed by the regenerator, and thus the relatively-low temperature working fluid flows to the cooling part. In addition, in a process that a working fluid flows from the cooling part to the high temperature part, the working fluid receives the heat absorbed by the regenerator, and thus the relatively-high temperature working fluid flows to the high temperature part.

Accordingly, when a working fluid flows from the high temperature part to the cooling part, the regenerator has to absorb heat included in the working fluid as much as possible. In addition, when a working fluid flows from the cooling part to the high temperature part, the generator has to transmit heat to the working fluid as much as possible. According to those, efficiency of the regenerator is determined, and the efficiency of the cooler greatly affects efficiency of the cryocooler.

Many researches are ongoing in order to improve heat exchange efficiency of the regenerator. As a thermal energy storage material of the regenerator, a lamination body formed by laminating a plurality of meshes having fine holes is used, or a pressed stainless lump (cotton-shaped) made by lumping a fine stainless fiber is used. Of them, the stainless lump is frequently used because it has better efficiency than the mesh laminated body.

However, the regenerator using the stainless lump or the mesh laminated body is very heavy. In general, because the cooling part of the cryocooler comes into a cryogenic state in operation, lubricating oil freezes and thus cannot be used, and therefore a fluid bearing is used. For this reason, in case that a heavy regenerator of the cryocooler makes a relative motion, abrasion occurs at the regenerator and a component which makes relative motion with the regenerator, thereby deteriorating reliability and consuming a large amount of operation energy.

SUMMARY OF THE INVENTION

Therefore, an object of the present invention is to provide a regenerator and a cryocooler using the same capable of improving regeneration performance of storing heat included in a working fluid and transmitting the stored heat to the working fluid and of minimizing its weight.

To achieve these and other advantages and in accordance with the purpose of the present invention, as embodied and broadly described herein, there is provided a regenerator comprising: a casing including a connection channel for making a high temperature part and a cooling part communicate with each other; and a thermal energy storage material inserted in the connection channel of the casing and made of an aramid fiber which stores and radiates heat of a working fluid flowing through the connection channel.

To achieve these and other advantages and in accordance with the purpose of the present invention, as embodied and broadly described herein, there is provided a cryocooler comprising: a closed container having a predetermined shape; a driving motor mounted in the closed container, for generating a linear reciprocating driving force; a cylinder mounted in the closed container and filled with a working fluid; a piston receiving the driving force of the driving motor, for pumping the working fluid while moving back and forth in the cylinder; a cold finger tube protrusively coupled at one side of the closed container and forming a closed operation space together with the inside of the cylinder; a displacer connected to an elastic member mounted to the closed container, for compressing/expanding the working fluid while moving back and forth in the operation space according to the movement of the piston; and a regenerator including a thermal energy storage material made of an aramid fiber which absorbs and stores/radiates heat included in the working fluid flowing between a high temperature part where the working fluid is compressed and a cooling part where the working fluid is expanded.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
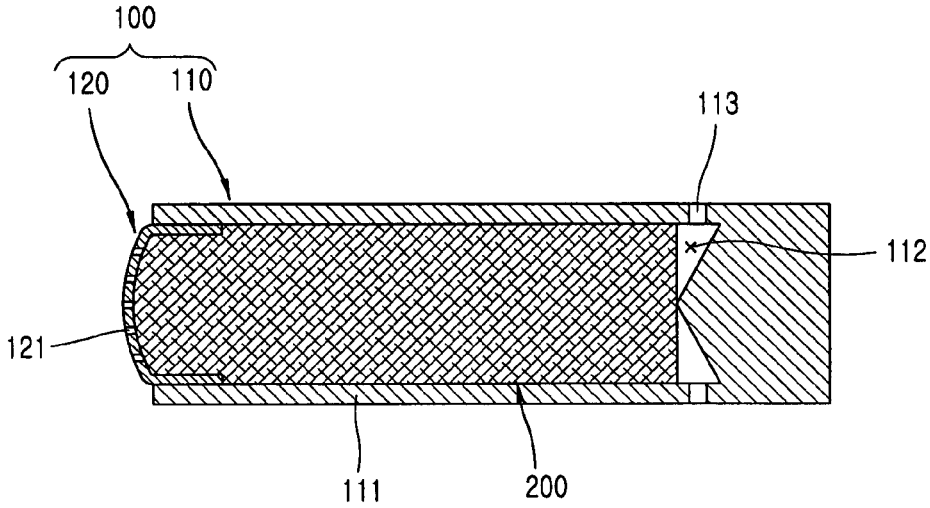
FIGS. 1 and 2 are sectional views showing a regenerator in accordance with one embodiment of the present invention, respectively.

FIG. 1 is a sectional view showing one embodiment of a regenerator in accordance with the present invention.

As shown therein, the regenerator includes a casing 100 including a connection channel for making a high temperature part (not shown) and a cooling part (not shown) communicate; and a thermal energy storage material 200 inserted in the connection channel of the casing 100 and made of an aramid fiber absorbing and storing heat included in a working fluid flowing through the connection channel and radiating the stored heat to a working fluid.

The casing 100 includes an one side-closed type cylindrical case 110 having a cylindrical insertion groove 112 which is formed at one side of a cylindrical body 111 having a certain outer diameter and a length and has a predetermined inner diameter and a depth, and first through holes 113 formed at one side of the cylindrical body 111 and communicating with the insertion groove 112; and a cover 120 coupled to one side of the one side-closed type cylindrical case 110, for covering the insertion groove 112. A plurality of second through holes 121 are formed at the cover 120.

Preferably, the insertion groove 112 of the one side-closed type cylindrical case is formed in a longitudinal direction of the cylindrical body 111, and the first through holes 113 are formed at an outer circumferential surface of the cylindrical body 111.

The thermal energy storage material 200 is formed as a cotton-shaped aramid fiber. The aramid lump (cotton-shaped) is inserted into the casing 100. That is, the insertion groove 112 of the one side-closed type cylindrical case constituting the casing 100 is stuffed with an aramid lump, and then the cover 120 is coupled to the one side-closed type cylindrical case 110 to thereby cover the insertion groove 112.

The casing 100 may be variously formed, including the form described above.

Figure 2:
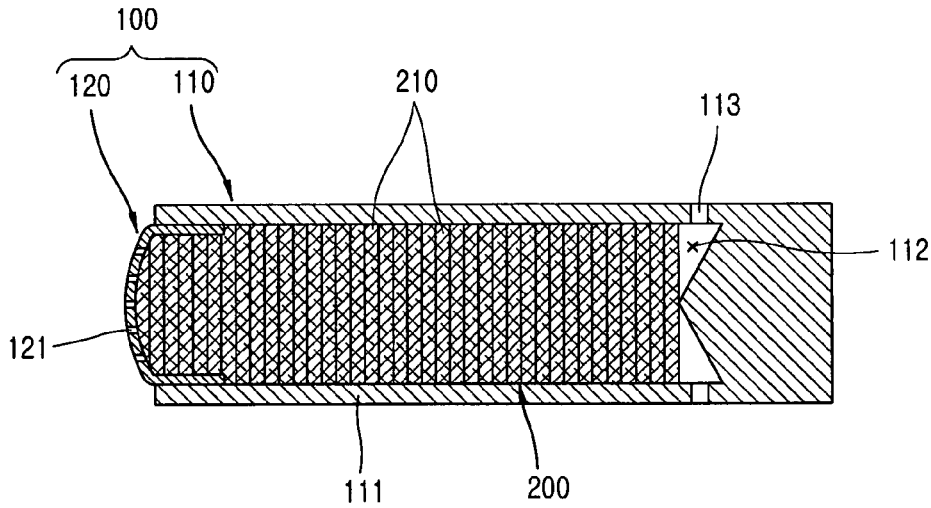

As shown in FIG. 2, as a modified example of the thermal energy storage material 200, the thermal energy storage material 200 is made of a fabric having a predetermined shape and made from an aramid fiber. The thermal energy storage material is formed such that the aramid fabric 210 is formed in a circular shape corresponding to a sectional shape of the casing 100, and a plurality of circular aramid fabrics 210 are laminated. Namely, a plurality of circular aramid fabrics 210 are laminated in the insertion groove 112 of the one side-closed type cylindrical case constituting the casing 100, and the cover 120 is coupled to the one side-closed type cylindrical case 110 to thereby cover the insertion groove 112.

In case that the thermal energy storage material 200 is an aramid lump, porosity of the thermal energy storage material 200 is varied according to the amount of aramid lump inserted in the casing 100, and, in case that the thermal energy storage material 200 is an aramid fabric, porosity of the thermal energy storage material 200 is varied according to the size of a mesh of the fabric.

The porosity of 45%~65% is effective for a pulse tube cooler, and the porosity of 75%~95% is effective for a Stirling cycle cooler.

The regenerator is positioned between the high temperature part where a working fluid is compressed and the cooling part where a working fluid is expanded, that is, at a channel for connecting the high temperature part and the cooling part. The first through holes 113 of the regenerator are positioned toward the high temperature part, and the second through holes 121 are positioned at the cooling part.

When the working fluid flows from the high temperature part to the cooling part, the heated working fluid is introduced to the insertion groove 112 through the first through holes 113, and the working fluid introduced into the insertion groove 112 passes through a thermal energy storage material 200 made of an aramid fiber and is discharged through the second through holes 121. In such a process, the heat of the working fluid heated at the high temperature part is absorbed and stored by the thermal energy storage material 200 while the working fluid passes through the thermal energy storage material 200 made of an aramid fiber. Thusly, the relatively low temperature working fluid is discharged through the second through holes 121.

And, when the working fluid flows from the cooling part to the high temperature part, the cooled working fluid is introduced into the insertion groove 112 through the second penetrating openings 121, and the working fluid introduced into the insertion groove 112 passes through the thermal energy storage material 200 made of an aramid fiber and is discharged through the first through holes 113. In such a process, the working fluid cooled in the cooling part receives heat stored in the thermal energy storage material 200 while passing through the thermal energy storage material 200 made of an aramid fiber. Thereupon, the relatively-high temperature working fluid is discharged through the first through holes 113. The working fluid discharged through the first through holes 113 is introduced into the high temperature part.

As described above, while the working fluid flowing between the high temperature part and the cooling part passes through a thermal energy storage material 200 made of an aramid fiber, the thermal energy storage material 200 is effectively absorbs and stores heat included in the working fluid and also effectively transmits the stored heat to the working fluid, thereby improving heat efficiency. In addition, a weight becomes very light because the thermal energy storage material 200 is made of an aramid fiber.

Figure 3:
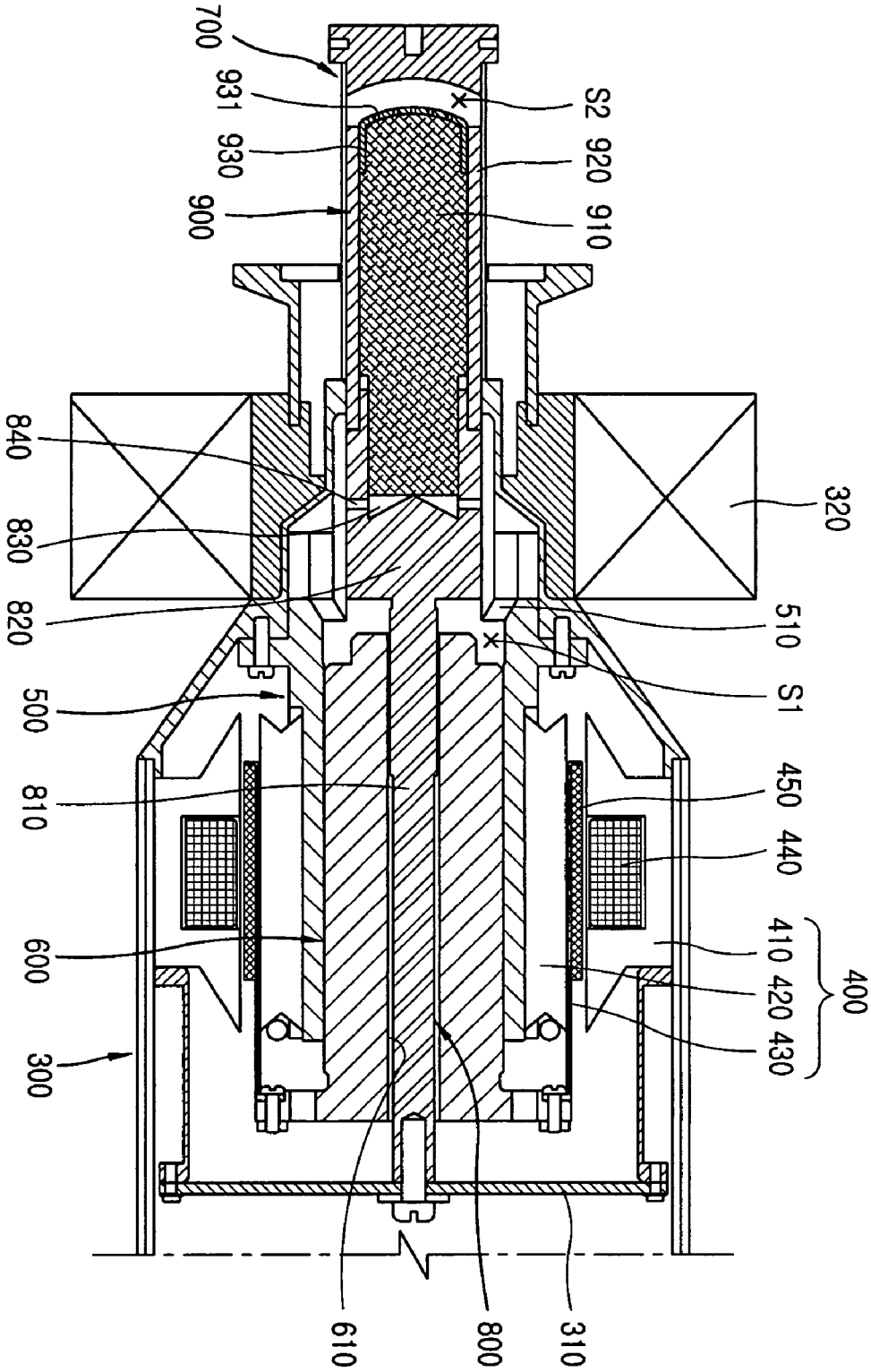
FIG. 3 is a sectional view showing a cryocooler in accordance with the present invention.

FIG. 3 is a sectional view showing one embodiment of a cryocooler in accordance with the present invention.

As shown therein, the cryocooler includes: a driving motor 400 mounted in a closed container, for generating a linear reciprocating driving force; a cylinder 500 mounted in the closed container 300 and filled with a working fluid; a piston 600 receiving a driving force of the driving motor 40, for pumping the working fluid while moving back and forth in the cylinder 500; a cold finger tube 700 coupled to the closed container 300 and forming a closed operation space together with the inside of the cylinder 500; a displacer 800 connected to an elastic member 310 mounted to the closed container 300, for compressing/expanding working fluid while moving back and forth in the operation spacer according to a movement of the piston 600; and a regenerator 900 including a thermal energy storage material 910 made of an aramid fiber absorbing and storing heat included in the working fluid and radiating the stored heat to the working fluid.

The driving motor 400 includes an outer stator 410 fixed at an inner wall of the closed container 300; an inner stator 420 fixedly coupled to the cylinder 500 at a certain interval between itself and the outer stator 410; and a rotor 430 movably inserted between the outer stator 410 and the inner stator 420. The outer stator 410 includes a winding coil 440, and the rotor 430 includes a permanent magnet 450.

The cylinder 500 is positioned at a central portion of the closed container 300, the piston 600 is inserted in the cylinder 500, and one side of the piston 600 is connected to the rotor 430.

The elastic member 310 is a leaf spring having a predetermined shape, and the leaf spring is positioned at a certain interval between itself and the piston 600.

The cold finger tube 700 is formed in a cylindrical shape one side of which is closed. The closed portion of the cold filer tube 700 is protruded outside from the closed container 300, and its opened portion is fixedly coupled at one side of the closed container 300, communicating with an inner space of the cylinder 500.

The displacer 800 includes a first sliding shaft portion 810 having a certain length and an outer diameter; a second sliding shaft portion 820 extended from the first sliding shaft portion 810 at a certain length, having an outer diameter greater than the first sliding shaft portion 810; a groove 830 formed at an end portion of the sliding shaft portion 820 and having a certain inner diameter and a depth; first through holes 840 formed at one side of the sliding shaft portion 820 and communicating with the groove 830. As for the displacer 800, the first sliding shaft portion 810 is inserted in a through hole 610 penetrating the inside of the piston 600, and the first sliding shaft portion 810 is fixedly coupled to the elastic member 310, positioning the second sliding shaft portion 820 in the operation space.

The regenerator 900 includes a cylindrical case 920 formed in a tube shape having a certain length, coupled to the second sliding shaft portion 820 of the displacer 800 to thereby form an insertion groove together with a groove 830 of the second sliding shaft portion; a thermal energy storage material 910 inserted in the insertion groove and made of an aramid fiber; and a cover 930 for covering the cylindrical case 920. A plurality of second through holes 931 are formed at the cover 930.

The thermal energy storage material 910 is formed as a cotton-shaped aramid fiber. The aramid lump (cotton-shaped) is inserted in the insertion groove. The aramid fiber is made of a nonmetallic material and is not transformed at a high temperature.

Figure 4:
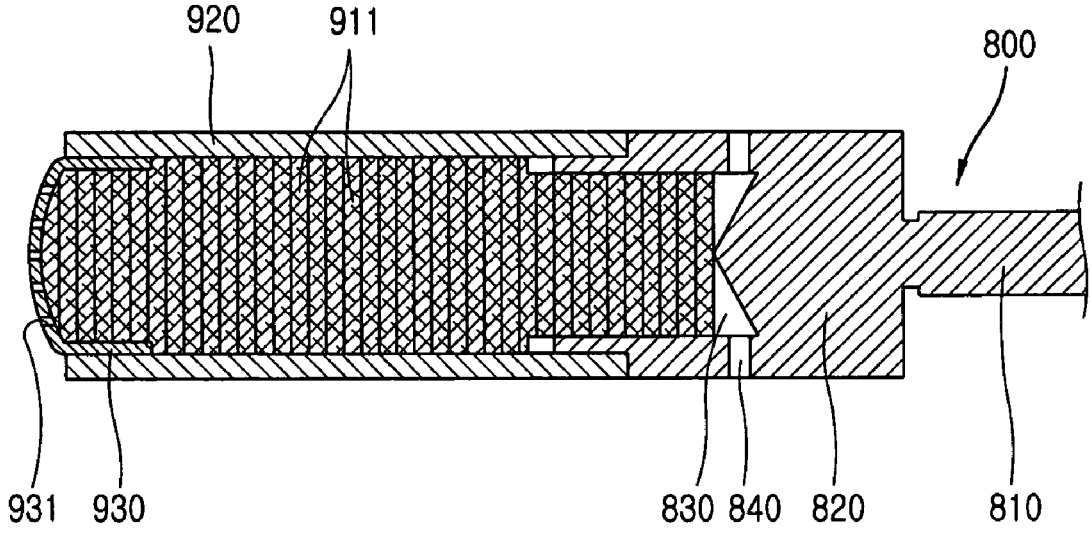
FIG. 4 is a sectional view showing a modified example of a regenerator constituting the cryocooler.

As a different embodiment of the thermal energy storage material 910, as shown in FIG. 4, the thermal energy storage material 910 is formed such that a fabric 911 of a predetermined shape is made from an aramid fiber and a plurality of aramid fabrics 911 of predetermined shape are laminated.

The fabric 911 of the predetermined shape is formed in a circular shape corresponding to an inner sectional shape of the insertion groove.

In case that the thermal energy storage material 910 is an aramid lump, porosity of the thermal energy storage material 910 is varied according to the amount of aramid lump inserted in the insertion groove, that is, in an inner space of the regenerator. In case that the thermal energy storage material 910 is an aramid fabric, the porosity is varied according to the size of a mesh of the fabric. The porosity of 45%~65% is effective for a pulse tube cooler, and the porosity of 75%~95% is effective for a Stirling cycle cooler.

The regenerator 900 is coupled to the displacer 800 and is movably positioned in an operation space formed by an inner space of the cold finger tube 700 and an inner space of the cylinder 500. And, the second sliding shaft portion 820 of the displacer and the regenerator 900 divide an operation space into a space (S1) where a working fluid is compressed and a space (S2) where a working fluid is expanded.

Non described reference numeral 320 is a heat radiating means, and 510 is a fluid passage.

An operation of the cryocooler described above will now be described.

First, when power is applied to the cryocooler, a driving motor 400 operates, generating a linear reciprocating driving motor. The driving force of the driving motor 400 is transmitted to a piston 600, and thus the piston 600 moves back and forth in a cylinder 500.

When the piston 600 moves forth, a working fluid is compressed and heated in an internal space of the cylinder 500 between one side surface of the second sliding shaft portion 820 of the displacer and the piston 600, and the compressed and heated working fluid is introduced into an insertion groove of a regenerator 900 through a fluid passage 510 formed at an end portion of the cylinder 500 and first through holes 840 of the second sliding shaft portion 820. The working fluid introduced into the insertion groove passes through a thermal energy storage material 910 made of an aramid fiber and is introduced into an internal space of one side of a cold finger tube 700. While the compressed and heated working fluid passes through the thermal energy storage material 910 made of aramid fiber, heat of the working fluid is absorbed and stored in the thermal energy storage material 910 so that the temperature of the working fluid becomes relatively low. The relatively-low temperature working fluid is discharged through the second through holes 931.

And, upon applying pressure of the working fluid compressed as the piston 600 moves forth, the displacer moves forth by being elastically supported by an elastic member 310. Together with such a forward movement of the displacer 800, the regenerator 900 moves forth. A time difference is made between forward movements of the displacer 800 and the regenerator 900 and a forward movement of the piston 600.

When the piston 600 moves back, the displacer 800 and the regenerator 900 move back by a pressure difference of an internal space of the cylinder and a restoration force of the elastic member 310.

As the displacer 800 and the regenerator 900 move back, the working fluid introduced into the internal space of one side of the cold finger tube 700 is rapidly expanded, thereby absorbing external heat. Thereupon, one portion of the cold finger tube 700, where the working fluid is expanded is cooled to be in a cryogenic state. The portion of the cold finger tube 700, which is cooled, is a cooling part.

The working fluid a temperature of which is relatively lowered by being expanded in the internal space of the cold finger tube 700 is introduced into the insertion groove of the regenerator 900 through the second through holes 931. The working fluid introduced into the insertion groove passes through the thermal energy storage material and is introduced into the internal space of the cylinder between the second sliding shaft portion 820 and the piston 600 through the first through holes 840 and the fluid passage 510. While the low temperature working fluid passes through the thermal energy storage material 910 made of the aramid fiber, heat absorbed and stored in the thermal energy storage material 910 is transmitted to the working fluid. Thereby, the working fluid, a temperature of which is relatively high, is introduced into the internal space of the cylinder 500.

By repeating such processes, the internal space of the cylinder 500, in which the working fluid is compressed maintains a high temperature, and one side of the cold finger tube 700, that is, a portion protruded outside from the closed container 300, where the working fluid is expanded, maintains a cryogenic temperature.

Thus, in the cryocooler, the piston 600 pumps the working fluid in the cylinder 500 by driving of the driving motor 400, and, as the piston 600 moves, the displacer 800 moves to expand the working fluid so that a temperature of one portion of the cold finger tube 700 is lowered to a cryogenic temperature within a short time.

In addition, because the thermal energy storage material 910 constituting the regenerator 900 is made of an aramid fiber, a nonmetallic material, a weight of the regenerator 900 becomes very light. Accordingly, a weight of an assembly of the regenerator 900 and the displacer 800 becomes relatively light. For this reason, if the assembly is positioned in a horizontal direction, the assembly is prevented from going down so that abrasion between the displacer 800 and the piston 600 and between the piston 600 and the cylinder 500 is minimized. Due to a decrease in abrasion and a light regenerator, the amplitude of the displacer and the regenerator is relatively increased, thereby improving expansion effect of the working fluid and reliability of components.

In addition, because the thermal energy storage material 910 of the regenerator 900, which is positioned between a compression space, the high temperature part and an expansion space, the refrigerating unit, absorbs and stores heat of a working fluid flowing between the compression space and the expansion space and discharges the stored heat to a working fluid, is made of aramid fiber, the thermal energy storage material 910 is not easily transformed at a high temperature and also has excellent heat storing/discharging efficiency. Accordingly, performance of the regenerator 900 is improved so that performance of the cryocooler is greatly improved.

A result obtained by comparing a weight and an electric heating surface of a thermal energy storage material made of aramid fiber with those of a thermal energy storage material made of stainless fiber, which is generally used, shows that the thermal energy storage material made of an aramid fiber has a weight of about 4.4 g and an electric heating surface of about 1.0592 $m^2$ in a state that the porosity is about 80%, but the thermal energy storage material made of a stainless fiber has a weight of about 14.5 g and an electric heating surface of about 0.5296 $m^2$ in a state that the porosity is about 90%.

Thus, when a diameter of the thermal energy storage material of an aramid fiber is the same as that of the thermal energy storage material of a stainless fiber, the weight of the thermal energy storage material of aramid fiber is smaller than the weight of the thermal energy storage material of stainless fiber by about ¼, and the electric heating surface of the aramid fiber is greater than that of the stainless fiber by 2.5 times. This result shows that the aramid fiber has a bigger heat transmission area than the stainless fiber has.

In addition, a result obtained by comparing cooling capacity of a cryocooler having a thermal energy storage material of a regenerator, which is made of stainless fiber with cooling capacity of a cryocooler having a thermal energy storage material of a regenerator in accordance with the present invention shows that power of the cryocooler in accordance with the present invention is 28.46 W and its cooling capacity is 0.249, but power of the cryocooler having a thermal energy storage material of a regenerator, which is made of stainless fiber is 15.86 W and its cooling capacity is 0.167. Thus, the cryocooler in accordance with the present invention has power that is almost twice greater than that of the cryocooler made of stainless fiber and also has better performance.

As so far described, a regenerator in accordance with the present invention and a cryocooler using the same can improve regeneration performance of storing heat included in a working fluid and transmitting the stored heat to the working fluid and minimize abrasion of components which make relative motions thanks to a weight decrease, thereby improving its performance and reliability.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A regenerator comprising:

a casing including a connection channel for communicating a high temperature part and a cooling part; and a thermal energy storage material located in the connection channel of the casing, the cross section of the thermal energy storage material being substantially equal to the cross section of the connection channel, the thermal energy storage material being made substantially entirely of an aramid fiber which stores/radiates heat of a working fluid flowing through the connection channel.

2. The regenerator of claim 1, wherein the thermal energy storage material includes a plurality of circular fabrics of the aramid fiber.

3. The regenerator of claim 2, wherein the plurality of circular fabrics of the aramid fiber are laminated with each other, each of the circular fabrics of the aramid fiber having a cross section substantially occupying the entire cross section of the connection channel.

4. The regenerator of claim 1, wherein porosity of the thermal energy storage material inserted in the casing is 45%~65%.

5. The regenerator of claim 1, wherein porosity of the thermal energy storage material inserted in the casing is 75%~95%.

6. A cryocooler comprising:

a closed container having a predetermined shape;

a driving motor mounted in the closed container, for generating a linear reciprocating driving force;

a cylinder mounted in the closed container and filled with a working fluid;

a piston receiving the driving force of the driving motor, for pumping the working fluid while moving back and forth in the cylinder;

a cold finger tube protrusively coupled at one side of the closed container and forming a closed operation space together with the inside of the cylinder;

a displacer connected to an elastic member mounted to the closed container, for compressing/expanding the working fluid while moving back and forth in the operation space according to the movement of the piston; and a regenerator including:

a casing including a connection channel for communicating a high temperature part and a cooling part; and a thermal energy storage material located in the connection channel of the casing, the cross section of the thermal energy storage material being substantially equal to the cross section of the connection channel, the thermal energy storage material being made substantially entirely of an aramid fiber which absorbs and stores/radiates heat included in the working fluid flowing through the connection channel and between the high temperature part where the working fluid is compressed and the cooling part where the working fluid is expanded.

7. The cryocooler of claim 6, wherein the thermal energy storage material includes a plurality of circular fabrics of the aramid fiber.

8. The cryocooler of claim 7, wherein the plurality of circular fabrics of the aramid fiber are laminated with each other, each of the circular fabrics of the aramid fiber having a cross section substantially occupying the entire cross section of the connection channel.

9. The cryocooler of claim 6, wherein porosity of the thermal energy storage material is 45%~65%.

10. The cryocooler of claim 6, wherein porosity of the thermal energy storage material is 75%~95%.

11. The cryocooler of claim 6, wherein the displacer and the regenerator form an assembly by being integrally coupled, and the assembly is positioned in an operation space.

12. The cryocooler of claim 11, wherein the assembly comprises:

a first sliding shaft portion penetratingly inserted in the piston and having one side coupled to the elastic member;

a second sliding shaft portion extended from one side of the first sliding shaft portion at a certain length, having a diameter greater than an outer diameter of the first sliding shaft portion;

a groove formed at an end surface of the second sliding shaft portion;

at least one first through hole formed at one side of the second sliding shaft portion, the first through hole extending from the groove to communicate with the high temperature part;

a cylindrical case coupled to the second sliding shaft portion and communicating with the groove of the second sliding shaft portion;

the thermal energy storage material inserted in an insertion groove inside of the cylindrical case; and a cover covering the insertion groove by being coupled to an end portion of the second sliding shaft portion and having a plurality of second through holes for connecting the insertion groove and the cooling part therein, wherein the groove is enclosed by the end surface of the second sliding shaft portion and the thermal energy storage material, the working fluid being introduced into the groove after the working fluid flows through the at least one first through hole and toward the cooling part.

* * * * *